US011276372B2

(12) United States Patent
Uchiyama

(10) Patent No.: US 11,276,372 B2
(45) Date of Patent: Mar. 15, 2022

(54) METHOD OF OPERATION OF DISPLAY DEVICE AND DISPLAY DEVICE

(71) Applicant: SEIKO EPSON CORPORATION, Tokyo (JP)

(72) Inventor: Yoshiteru Uchiyama, Suwa (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/893,488

(22) Filed: Jun. 5, 2020

(65) Prior Publication Data

US 2020/0388244 A1 Dec. 10, 2020

(30) Foreign Application Priority Data

Jun. 7, 2019 (JP) ..... JP2019-106718

(51) Int. Cl.
*G09G 5/14* (2006.01)

(52) U.S. Cl.
CPC ..... *G09G 5/14* (2013.01); *G09G 2340/12* (2013.01); *G09G 2354/00* (2013.01)

(58) Field of Classification Search
CPC ... G09G 5/14; G09G 2354/00; G09G 2340/12
See application file for complete search history.

(56) References Cited

U.S. PATENT DOCUMENTS

2009/0244376 A1* 10/2009 Asano ..... H04N 9/3185 348/564
2012/0249741 A1* 10/2012 Maciocci ..... G06T 15/503 348/46
2019/0026063 A1* 1/2019 Mabey ..... G06F 3/017

FOREIGN PATENT DOCUMENTS

| | | | | |
|---|---|---|---|---|
| JP | 2002-341845 | A | | 11/2002 |
| JP | 2008-225175 | A | | 9/2008 |
| JP | 2009-140382 | A | | 6/2009 |
| JP | 2013171354 | A | * | 9/2013 |
| JP | 2014-33381 | A | | 2/2014 |
| JP | 2014033381 | A | * | 2/2014 |

* cited by examiner

*Primary Examiner* — Samantha (Yuehan) Wang
(74) *Attorney, Agent, or Firm* — Oliff PLC

(57) ABSTRACT

A method of operation performed by a display device displaying an image on a display surface includes the steps of displaying a first image in the display surface's first area, and displaying second image in a second area different from the display surface's first area, displaying a third image formed by superimposing a writing image to the second image on the second image in second area instead of the second image, determining whether or not a condition for changing an image to be displayed in the first and second area is fulfilled, and changing the image to be displayed in the first area from first image to third image and changing image to be displayed in second area from third image to a fourth image when it is determined that the condition is wherein the first image is displayed in first area and third image is displayed in second area.

6 Claims, 7 Drawing Sheets

METHOD OF OPERATION OF DISPLAY DEVICE AND DISPLAY DEVICE

The present application is based on, and claims priority from JP Application Serial Number 2019-106718, filed Jun. 7, 2019, the disclosure of which is hereby incorporated by reference herein in its entirety.

BACKGROUND

1. Technical Field

The present disclosure relates to a method of operation of a display device and a display device.

2. Related Art

In JP-A-2008-225175 (Document 1), there is described a display device which displays an image represented by image data supplied from an image data supply device such as a PC (Personal Computer).

When receiving first image data from the image data supply device, the display device described in Document 1 stores the first image data in a first buffer. Subsequently, the display device displays a first image represented by the first image data stored in the first buffer in a second area on a display surface. Subsequently, when receiving second image data from the image data supply device, the display device stores the second image data in a second buffer. Subsequently, the display device displays a second image represented by the second image data stored in the second buffer in the second area instead of the first image, and at the same time, displays the first image represented by the first image data stored in the first buffer in a first area on the display surface.

Even when writing of a line or the like is performed on the first image in the second area in accordance with an operation of a pointing element such as an electronic pen before receiving the second image data, the display device described in Document 1 displays the first image represented by the first image data stored in the first buffer, namely the first image on which the writing is not reflected, in the first area when receiving the second image data. Therefore, it is not achievable for the display device described in Document 1 to display the content of the writing in the first area even when it is desirable to keep the display of the content of the writing performed in the second area.

SUMMARY

A method of operation according to an aspect of the present disclosure is a method of operation performed by a display device configured to display an image on a display surface including the steps of displaying a first image in a first area of the display surface, and displaying a second image in a second area different from the first area of the display surface, displaying a third image formed by superimposing a writing image based on a writing operation to the second image on the second image in the second area instead of the second image, determining whether or not a condition for changing an image to be displayed in the first area and an image to be displayed in the second area is fulfilled, and changing the image to be displayed in the first area from the first image to the third image and changing the image to be displayed in the second area from the third image to a fourth image when it is determined in the determination that the condition is fulfilled in a circumstance in which the first image is displayed in the first area and the third image is displayed in the second area.

A display device according to an aspect of the present disclosure is a display device configured to display an image on a display surface including a display section configured to display a first image in a first area of the display surface, and display a second image in a second area different from the first area of the display surface, a display control section configured to control the display section, and a determination section configured to determine whether or not a condition for changing an image to be displayed in the first area and an image to be displayed in the second area is fulfilled, wherein the display control section makes the display section perform an operation of displaying a third image formed by superimposing a writing image based on a writing operation to the second image on the second image in the second area instead of the second image, and an operation of changing the image to be displayed in the first area from the first image to the third image and changing the image to be displayed in the second area from the third image to a fourth image when it is determined that the condition is fulfilled in a circumstance in which the first image is displayed in the first area and the third image is displayed in the second area.

DESCRIPTION OF AN EXEMPLARY EMBODIMENT

A: First Embodiment

A1: Overview of Projector System 1000

Figure 1:
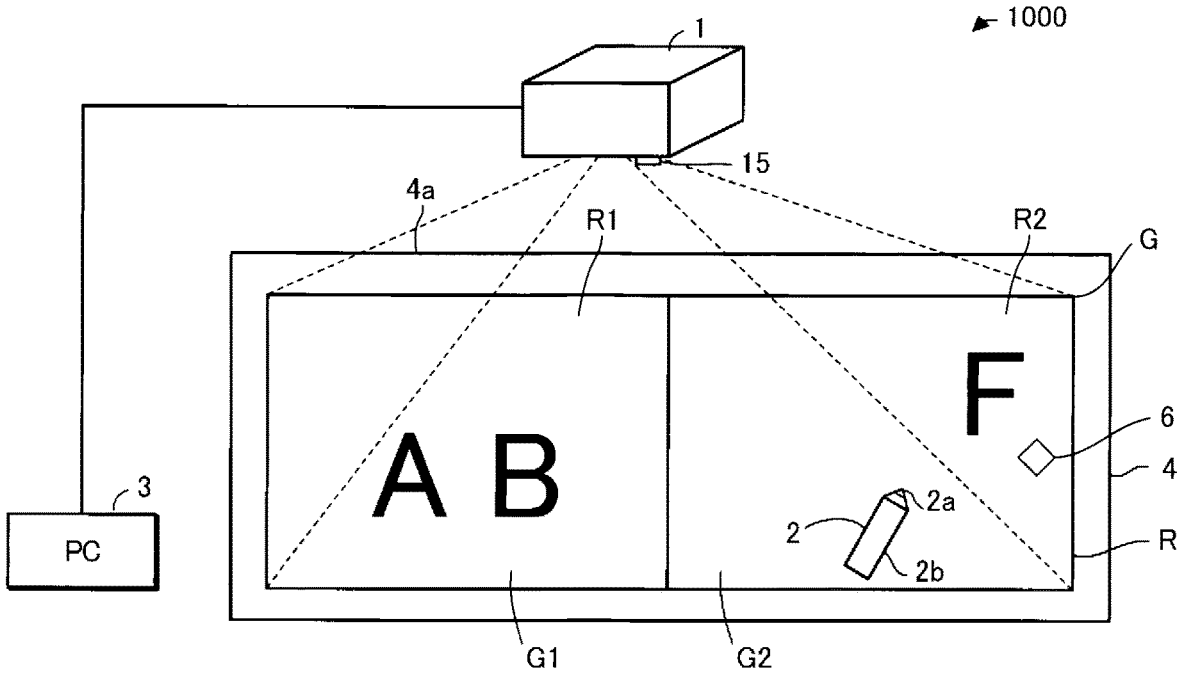
FIG. 1 is a diagram showing a projector system 1000 including a projector 1 according to a first embodiment.

FIG. 1 is a diagram showing a projector system 1000 including a projector 1 according to a first embodiment. The projector system 1000 includes the projector 1 and a pointing element 2.

The projector 1 is installed in a part of a wall located above an upper end 4*a* of a projection surface 4. The projector 1 can be installed on, for example, a desk, a table, or the floor, or can also be suspended from the ceiling instead of being installed on the wall. The projection surface 4 is, for example, a whiteboard. The projection surface 4 is not limited to the whiteboard, but can also be, for example, a screen fixed to the wall, a part of the wall, or a door. The projection surface 4 is an example of a display surface.

The projector 1 receives image data from a PC 3. The projector 1 receives the image data from the PC 3 with wire. The projector 1 can also receive the image data wirelessly from the PC 3.

The image data is data representing an image to be, for example, a material for a class. The image data is not limited to the data representing the image to be the material of the class, but can also be data representing an image to be, for example, a material for a presentation. Each of the image data represents a content of one page in the material. The PC 3 provides the image data in an ascending order of the pages in the material.

The PC 3 is an example of a supply source of the image data. The supply source of the image data can also be referred to as an image supply device. The supply source of the image data is not limited to the PC 3, but can also be, for example, a tablet terminal, a smartphone, or a so-called document camera.

The projector 1 projects an image on the projection surface 4 to thereby display the image on the projection surface 4. In FIG. 1, there is shown an aspect in which the projector 1 displays an image G on the projection surface 4. The projector 1 is an example of a display device. The display device is not limited to the projector 1, but can also be a display such as an FPD (Flat Panel Display). The FPD is, for example, a liquid crystal display, a plasma display, or an organic EL (Electro Luminescence) display. Out of the projection surface 4, an area where the image is projected is hereinafter referred to as a "projection area R." The shape of the projection area R is defined as the shape of the image to be projected from the projector 1.

Here, the image to be projected from the projector 1 will be described using an image G.

The image G has a landscape shape. The image G includes a first image G1 and a second image G2. The first image G1 and the second image G2 are arranged in a lateral direction, namely a horizontal direction. The size of the first image G1 is the same as the size of the second image G2. The size of the first image G1 can be different from the size of the second image G2. For example, the first image G1 can be larger than the second image G2. The first image G1 can be smaller than the second image G2. The first image G1 and the second image G2 can have contact with each other, or can also be separated from each other.

The projector 1 displays the first image G1 in a first area R1 located in a left part of the projection area R, and at the same time, displays the second image G2 in a second area R2 located in a right part of the projection area R.

When the projector 1 is used in a class of a school, the teacher proceeds with the class using the image displayed in the second area R2. The teacher supplementarily uses the image displayed in the first area R1. For example, in the first area R1, there is displayed the image having already been displayed in the second area R2. In other words, even when the image to be displayed in the second area R2 is switched, the image having been displayed in the second area R2 before the image is switched in the second area R2 is displayed in the first area R1.

Therefore, even when the image to be displayed in the second area R2 is switched before a student writes the image displayed in the second area R2 before the image has been switched in the second area R2, it becomes possible for the student to write the image, which has been displayed in the second area R2 before being switched in the second area R2, in a notebook.

The first image G1 is an image represented by first image data supplied from the PC 3 to the projector 1. In FIG. 1, there is shown an image showing "AB" as an example of the first image G1. The first image G1 is not limited to the image showing "AB," but can arbitrarily be changed.

The second image G2 is an image represented by second image data supplied from the PC 3 to the projector 1. In FIG. 1, there is shown an image showing "F" as an example of the second image G2. The second image G2 is not limited to the image showing "F," but can arbitrarily be changed. The second image data is supplied from the PC 3 to the projector 1 temporally posterior to the first image data.

On the second image G2, there is superimposed an update button 6 for updating the display of the image. In FIG. 1, there is shown an image showing a "rhombic figure" as an example of the update button 6. The shape of the update button 6 is not limited to a rhombus, but can also be, for example, a circle or a triangle.

The pointing element 2 is, for example, a pointing tool shaped like a pen. The shape of the pointing element 2 is not limited to the pen-like shape, but can also be, for example, a circular cylinder, a prismatic column, a circular cone, or a pyramidal shape. The user performs an operation on an image projected by the projector 1 using the pointing element 2. For example, the user grips a shaft part 2*b* of the pointing element 2, and translates the pointing element 2 on the projection surface 4 while making a tip 2*a* have contact with the projection surface 4.

The projector 1 images an area including the projection area R with a camera 15 to thereby generate imaging data. The projector 1 analyzes the imaging data to thereby identify a position of the pointing element 2, namely an operation position by the pointing element 2. For example, the projector 1 projects a line corresponding to the trajectory of the operation position by the pointing element 2 on the projection surface 4. Therefore, it is possible for the user to perform a writing operation using the pointing element 2. The line corresponding to the trajectory of the operation position by the pointing element 2 is an example of a writing image based on the writing operation.

The color of the line corresponding to the trajectory of the operation position by the pointing element 2 can be set in advance, or can also be arbitrarily changed in accordance with an operation on a color selection button not shown or a color selection icon not shown.

Figure 2:
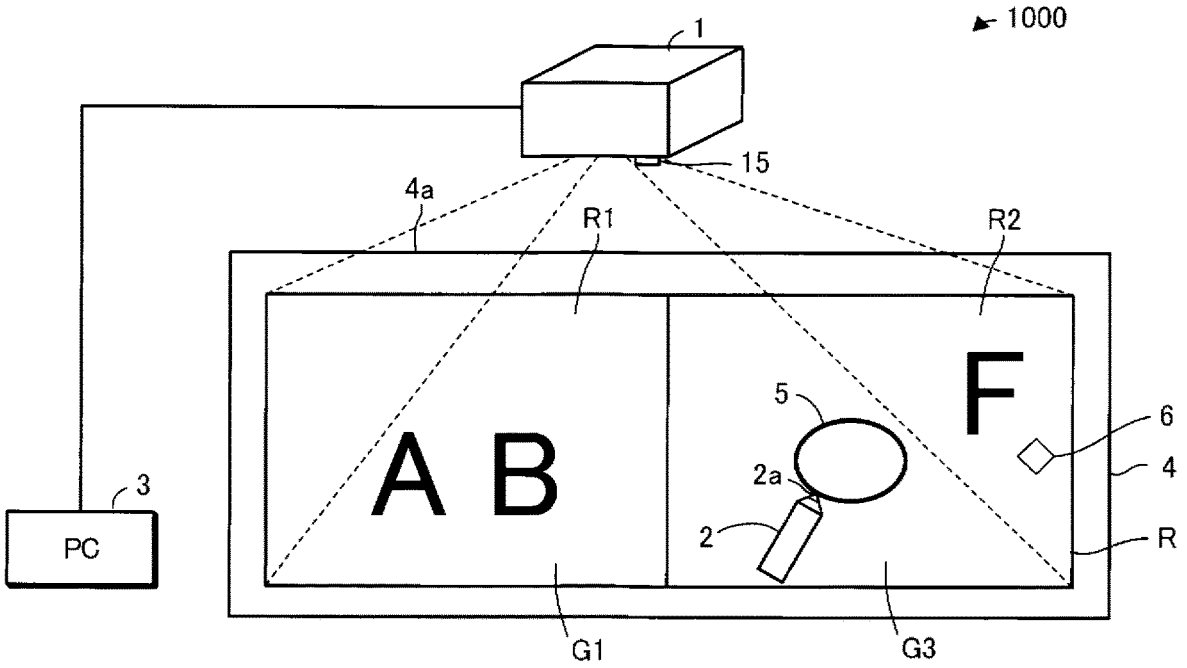
FIG. 2 is a block diagram showing the projector system 1000.

In FIG. 2, there is shown an image showing an ellipse as an example of the writing image 5. In the example shown in FIG. 2, a third image G3 formed by superimposing the writing image 5 on the second image G2 is displayed instead of the second image G2 in the second area R2.

The writing image 5 is not limited to the image showing an ellipse, but can arbitrarily be changed. The number of the writing images 5 included in the third image G3 can be larger than 1. It should be noted that it is also possible for the projector 1 to superimpose the writing image 5 on the first image G1.

When the projector 1 detects an operation on the update button 6 by the pointing element 2 by analyzing the imaging data, the projector 1 determines that a request instruction has been received from the user, the request instruction requesting subsequent image data to be supplied to the projector 1 temporally posterior to the second image data. In the present embodiment, the subsequent image data is different from the image data representing the second image G2, and a fourth image G4 represented by the subsequent image data is different from the second image G2.

When the projector 1 receives the request instruction from the user, the projector 1 requests the subsequent image data to the PC 3. When the PC 3 receives the request of the subsequent image data, the PC 3 supplies the subsequent image data to the projector 1.

Figure 3:
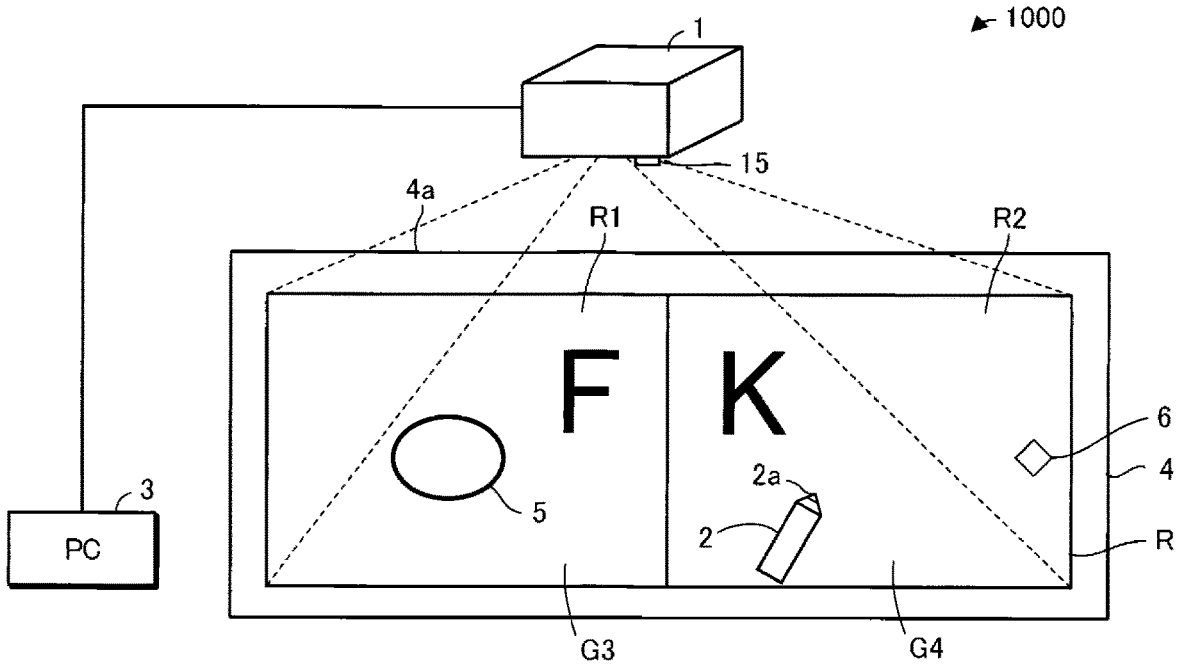
FIG. 3 is a block diagram showing the projector system 1000.

When the projector 1 receives the subsequent image data in such a circumstance in which the first image G1 is displayed in the first area R1 and the third image G3 is displayed in the second area R2 as shown in FIG. 2, the projector 1 changes the image to be displayed in the first area R1 from the first image G1 to the third image G3, and at the same time, changes the image to be displayed in the second area R2 from the third image G3 to the fourth image G4. Therefore, as shown in FIG. 3, the third image G3 including the writing image 5 moves from the second area R2 to the first area R1, and the fourth image G4 is displayed in the second area R2.

Figure 4:
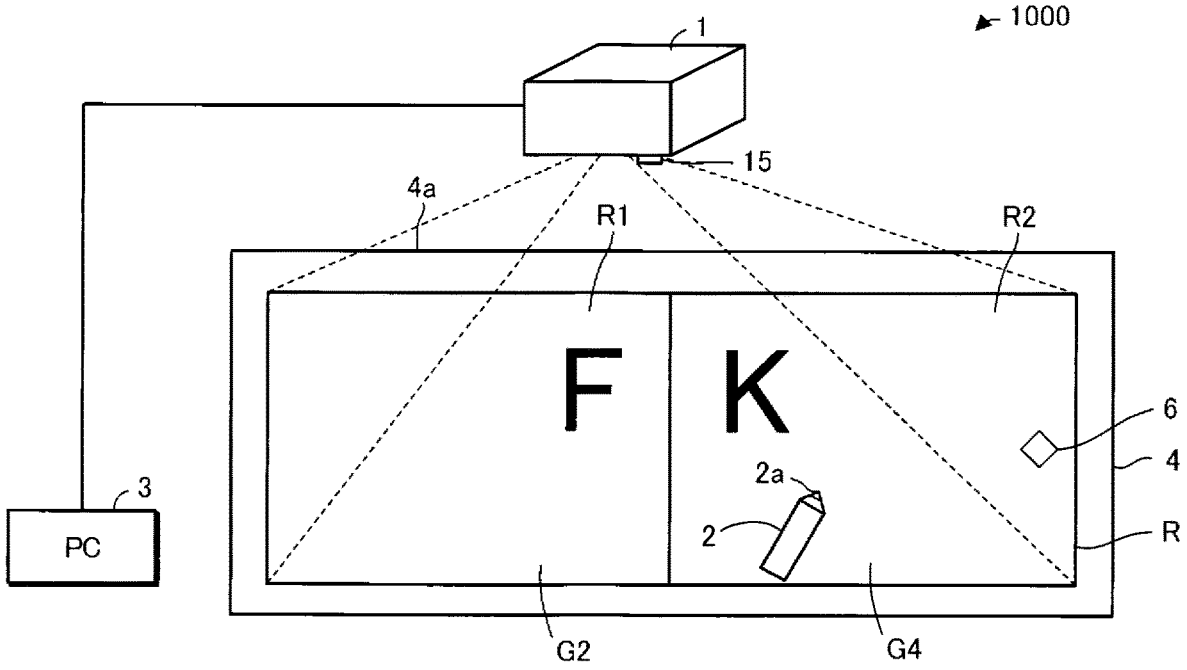
FIG. 4 is a block diagram showing the projector system 1000.

On the other hand, when the projector 1 receives the subsequent image data in such a circumstance in which the first image G1 is displayed in the first area R1 and the second image G2 is displayed in the second area R2 as shown in FIG. 1, the projector 1 changes the image to be displayed in the first area R1 from the first image G1 to the second image G2, and at the same time, changes the image to be displayed in the second area R2 from the second image G2 to the fourth image G4. Therefore, as shown in FIG. 4, the second image G2 moves from the second area R2 to the first area R1, and the fourth image G4 is displayed in the second area R2.

A2. One Example of Pointing Element 2

Figure 5:
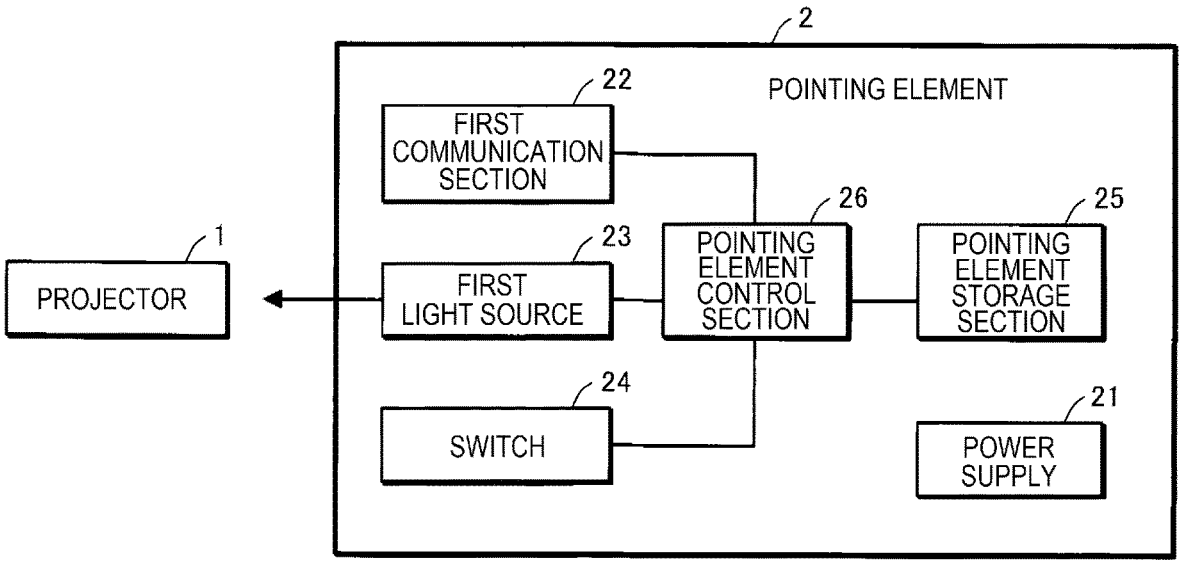
FIG. 5 is a diagram showing an example of a pointing element 2.

FIG. 5 is a diagram showing an example of the pointing element 2. The pointing element 2 includes a power supply 21, a first communication section 22, a first light source 23, a switch 24, a pointing element storage section 25, and a pointing element control section 26.

The power supply 21 supplies electrical power to the first communication section 22, the first light source 23, the switch 24, the pointing element storage section 25, and the pointing element control section 26. In FIG. 5, power lines used by the power supply 21 to supply the electrical power are omitted. When a power button not shown provided to the pointing element 2 is turned ON, the power supply 21 starts supplying the electrical power. When the power button is turned OFF, the power supply 21 stops supplying the electrical power.

The first communication section 22 performs wireless communication with the projector 1 using Bluetooth. Bluetooth is a registered trademark. Bluetooth is an example of a near field wireless communication system. The near field wireless communication system is not limited to Bluetooth, but can also be, for example, an infrared communication system or Wi-Fi. Wi-Fi is a registered trademark. The communication system of the wireless communication between the first communication section 22 and the projector 1 is not limited to the near field wireless communication system, but can also be other communication systems.

The first communication section 22 receives a sync signal from, for example, the projector 1. The sync signal is used for synchronizing the light emission timing of the pointing element 2 with the imaging timing of the camera 15 in the projector 1.

The first light source 23 is an LED (Light Emitting Diode) for emitting infrared light. The first light source is not limited to the LED, but can also be, for example, an LD (Laser Diode) for emitting the infrared light. The first light source 23 emits the infrared light for making the projector 1 recognize the operation position by the pointing element 2.

The switch 24 changes to an ON state when pressure acts on the tip 2*a* of the pointing element 2, and changes to an OFF state when the pressure acting on the tip 2*a* is released. The switch 24 functions as a sensor for detecting whether or not the tip 2*a* has contact with the projection surface 4.

The pointing element storage section 25 is a nonvolatile semiconductor memory such as a flash memory. The pointing element storage section 25 stores a control program to be executed by the pointing element control section 26, a variety of types of data to be used by the pointing element control section 26.

The pointing element control section 26 is formed of, for example, a single processor, or a plurality of processors. Citing an example, the pointing element control section 26 is formed of a signal CPU (Central Processing Unit) or a plurality of CPUs. Some or all of the functions of the pointing element control section 26 can also be configured by a circuit such as a DSP (Digital Signal Processor), an ASIC (Application Specific Integrated Circuit), a PLD (Programmable Logic Device), or an FPGA (Field Programmable Gate Array). The pointing element control section 26 executes a plurality of types of processing in parallel or in sequence.

The pointing element control section 26 executes the control program stored in the pointing element storage section 25 to thereby realize a variety of functions.

For example, in the circumstance in which the switch 24 is in the ON state, the pointing element control section 26 puts the first light source 23 ON at a timing specified with reference to the reception timing of the sync signal.

A3. One Example of Projector 1

Figure 6:
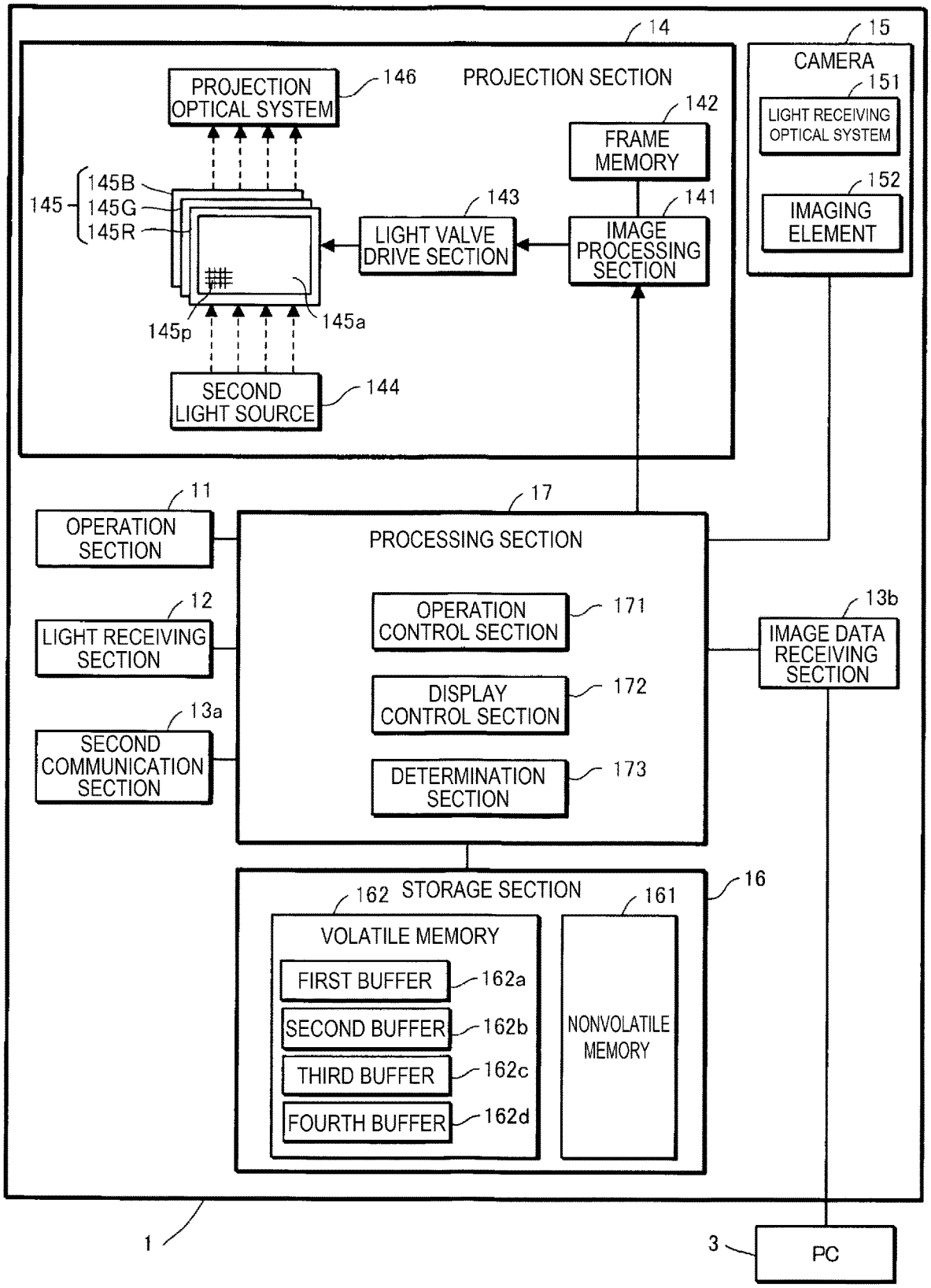
FIG. 6 is a diagram showing an example of the projector 1.

FIG. 6 is a diagram showing an example of the projector 1. The projector 1 includes an operation section 11, a light receiving section 12, a second communication section 13*a*, an image data receiving section 13*b*, a projection section 14, the camera 15, a storage section 16, and a processing section 17.

The operation section 11 corresponds to, for example, a variety of operating buttons, operating keys, or a touch panel. The operation section 11 is provided to the housing of the projector 1. The operation section 11 receives the input operation by the user.

The light receiving section 12 receives an infrared signal based on the input operation to a remote controller not shown from the remote controller. The remote controller is provided with a variety of operating buttons, operating keys, or a touch panel for receiving the input operation.

The second communication section 13*a* performs the wireless communication with the first communication section 22 of the pointing element 2 using Bluetooth. As described above, the communication system for the wireless communication is not limited to Bluetooth, but can also be, for example, infrared communication or Wi-Fi.

The image data receiving section 13*b* is coupled to the PC 3 using, for example, a wired LAN (Local Area Network). The coupling between the image data receiving section 13*b* and the PC 3 is not limited to the wired LAN, but can arbitrarily be changed. For example, the image data receiving section 13*b* can be coupled to the PC 3 via a wireless LAN, a USB (Universal Serial Bus) cable, an HDMI (High Definition Multimedia Interface) cable, or a VGA (Video Graphics Array) cable. USB is a registered trademark. HDMI is a registered trademark.

The projection section 14 projects an image on the projection surface 4 to thereby display the image on the projection surface 4. For example, the projection section 14 displays the first image G1 in the first area R1, and at the same time, displays the second image G2 in the second area R2. The projection section 14 is an example of a display section. The projection section 14 includes an image processing section 141, a frame memory 142, a light valve drive section 143, a second light source 144, a red-color liquid crystal light valve 145R, a green-color liquid crystal light valve 145G, a blue-color liquid crystal light valve 145B, and a projection optical system 146. Hereinafter, when there is no need to distinguish the red-color liquid crystal light valve 145R, the green-color liquid crystal light valve 145G, and the blue-color liquid crystal light valve 145B from each other, these are referred to as "liquid crystal light valves 145."

The image processing section 141 is formed of a circuit such as a single image processor or a plurality of image processors. The image processing section 141 receives image data from the processing section 17. For example, the image processing section 141 receives two image data from the processing section 17.

The image processing section 141 develops the image data on the frame memory 142.

When the image processing section 141 receives the two image data from the processing section 17, the image processing section 141 develops the two image data on the frame memory 142 so as not to overlap each other to thereby generate the image data representing the image to be projected in the projection area R.

For example, when the image processing section 141 receives the first image data and the second image data from the processing section 17, the image processing section 141 uses the frame memory 142 to generate the image data representing the image G.

The frame memory 142 is formed of a storage device such as a RAM (Random Access Memory). The image processing section 141 performs image processing on the image data having been developed on the frame memory 142 to thereby generate an image signal.

As the image processing executed by the image processing section 141, there are executed, for example, a geometric correction process of correcting the keystone distortion of the image to be projected by the projection section 14, and an OSD (On Screen Display) process of superimposing an OSD image on the image represented by the image data provided by the PC 3. As an example of the OSD image, there can be cited the update button 6 shown in FIG. 1.

The light valve drive section 143 is formed of a circuit such as a driver. The light valve drive section 143 drives the liquid crystal light valves 145 based on the image signal provided from the image processing section 141.

The second light source 144 is, for example, an LED. The second light source 144 is not limited to the LED, but can also be, for example, a xenon lamp, a super-high pressure mercury lamp, or a laser source. The light emitted from the second light source 144 is reduced in variation in the brightness distribution by an integrator optical system not shown, and is then separated by a color separation optical system not shown into colored light components of red, green, and blue as the three primary colors of light. The red colored light component enters the red-color liquid crystal light valve 145R. The green colored light component enters the green-color liquid crystal light valve 145G. The blue colored light component enters the blue-color liquid crystal light valve 145B.

The liquid crystal light valves 145 are each formed of a liquid crystal panel having a liquid crystal material existing between a pair of transparent substrates, and so on. The liquid crystal light valves 145 each have a pixel area 145*a* having a rectangular shape and including a plurality of pixels 145*p* arranged in a matrix. In each of the liquid crystal light valves 145, a drive voltage is applied to the liquid crystal for each of the pixels 145*p*. When the light valve drive section 143 applies the drive voltages based on the image signal to the respective pixels 145*p*, each of the pixels 145*p* is set to the light transmittance based on the drive voltage. The light emitted from the second light source 144 is modulated by passing through the pixel area 145*a*, and thus, the image based on the image signal is formed for each colored light. The liquid crystal light valves 145 are an example of the light modulation device.

The images of the respective colors are combined by a color combining optical system not shown for each of the pixels 145*p*, and thus, a color image is generated. The color image is projected via the projection optical system 146.

The camera 15 images the projection area R to thereby generate the imaging data. The camera 15 includes a light receiving optical system 151 such as a lens, and an imaging element 152 for converting the light collected by the light receiving optical system 151 into an electric signal. The imaging element 152 is, for example, a CCD (Charge Coupled Device) image sensor for receiving the light in, for example, an infrared region and a visible light region. The imaging element 152 is not limited to the CCD image sensor, but can also be a CMOS (Complementary Metal Oxide Semiconductor) image sensor for receiving the light in, for example, the infrared region and the visible light region.

The camera 15 can also be provided with a filter for blocking a part of the light entering the imaging element 152. For example, in the camera 15, when making the imaging element 152 receive the infrared light, the filter for mainly transmitting the light in the infrared region is disposed in front of the imaging element 152.

The camera 15 can be disposed as a separate member from the projector 1. In this case, the camera 15 and the projector 1 can be coupled to each other with a wired or wireless interface so as to be able to perform transmission/reception of data.

When the camera 15 performs imaging with the visible light, the image projected by the projection section 14 on the projection surface 4, for example, is taken. The imaging data generated by the camera 15 performing imaging with the visible light is hereinafter referred to as "visible light imaging data." The visible light imaging data is used in, for example, a calibration described later.

When the camera 15 performs imaging with the infrared light, the imaging data representing the infrared light emitted by, for example, the pointing element 2 is generated. The imaging data generated by the camera 15 performing imaging with the infrared light is hereinafter referred to as "infrared light imaging data." The infrared light imaging data is used for detecting, for example, the operation position by the pointing element 2 on the projection surface 4.

The storage section 16 is a recording medium which can be read by the processing section 17. The storage section 16 includes, for example, a nonvolatile memory 161 and a volatile memory 162. As the nonvolatile memory 161, there can be cited, for example, a ROM (Read Only Memory), an EPROM (Erasable Programmable Read Only Memory), and an EEPROM (Electrically Erasable Programmable Read Only Memory). As the volatile memory 162, there can be cited, for example, a RAM. The volatile memory 162 includes a first buffer 162*a*, a second buffer 162*b*, a third buffer 162*c*, and a fourth buffer 162*d*.

The first buffer 162*a* stores the image data representing the image to be displayed in the first area R1. The first buffer 162*a* stores, for example, the first image data.

The second buffer 162*b* stores the image data representing the image to be displayed in the second area R2. The second buffer 162*b* stores, for example, the second image data.

The third buffer 162*c* stores the image data representing a superimposed image in which the writing image is superimposed on the image to be displayed in the second area R2. The third buffer 162*c* stores, for example, the third image data representing the third image G3.

The fourth buffer 162*d* stores the image data representing a superimposed image in which the writing image is superimposed on the image to be displayed in the first area R1.

The processing section 17 is formed of, for example, a single processor, or a plurality of processors. Citing an example, the processing section 17 is formed of a single CPU or a plurality of CPUs. Some or all of the functions of the processing section 17 can be configured by a circuit such as a DSP, an ASIC, a PLD, or an FPGA. The processing section 17 executes a plurality of types of processing in parallel or in sequence.

The processing section 17 retrieves the control program from the storage section 16 and then executes the control program to thereby function as an operation control section 171, a display control section 172, and a determination section 173.

The operation control section 171 controls a variety of operations of the projector 1. For example, the operation control section 171 establishes the communication between the pointing element 2 and the second communication section 13*a*.

The operation control section 171 further executes the calibration. The calibration is a process of associating a coordinate on the frame memory 142 and a coordinate on the imaging data with each other. The coordinate on the frame memory 142 corresponds to a position on the image to be projected on the projection surface 4. By the position on the frame memory 142 and the position on the imaging data being associated with each other, it is possible to identify a part corresponding to the operation position by the pointing element 2 on the projection surface 4 in, for example, the image to be projected on the projection surface 4.

The calibration will hereinafter be described.

The operation control section 171 retrieves calibration image data from the storage section 16. It should be noted that it is also possible for the operation control section 171 to generate the calibration image data in accordance with the control program. The operation control section 171 provides the image processing section 141 with the calibration image data.

The image processing section 141 develops the calibration image data on the frame memory 142. The image processing section 141 performs a geometric correction process and the like on the calibration image data to generate the image signal. When the image processing section 141 provides the image signal to the light valve drive section 143, the calibration image in which marks each having a shape set in advance arranged with intervals is projected on the projection surface 4.

Subsequently, the operation control section 171 makes the camera 15 take the calibration image with the visible light. The camera 15 takes the calibration image with the visible light to thereby generate the visible light imaging data. Subsequently, the operation control section 171 obtains the visible light imaging data from the camera 15. The operation control section 171 detects the marks represented by the visible light imaging data. The operation control section 171 identifies a centroidal position of each of the marks as a coordinate of that mark in the imaging data.

Subsequently, the operation control section 171 performs association between the coordinates of the marks detected from the visible light imaging data and the coordinates of the marks on the frame memory 142. Due to the association, the operation control section 171 generates calibration data for associating a coordinate on the imaging data and a coordinate on the frame memory 142 with each other. The operation control section 171 stores the calibration data in the storage section 16.

The description of the calibration is hereinabove presented.

After completing the calibration, the operation control section 171 makes the camera 15 perform imaging with the infrared light at constant time intervals to generate the infrared light imaging data. Further, the operation control section 171 transmits the sync signal synchronized with the imaging timing of the camera 15 from the second communication section 13*a* to the pointing element 2.

The display control section 172 controls the projection section 14. The display control section 172 controls the projection section 14 to thereby control the image to be projected by the projection section 14 on the projection area R.

The determination section 173 determines whether or not the condition for changing the image to be displayed in the first area R1 and the image to be displayed in the second area R2 is fulfilled. This condition is hereinafter referred to as a "change condition."

The change condition is a first condition that the projector 1 receives the subsequent image data. It should be noted that the change condition is not limited to the first condition, but can arbitrarily be changed.

The determination result by the determination section 173 is used by the display control section 172.

For example, when the result of the determination by the determination section 173 is affirmative in the circumstance in which the third image G3 is displayed in the second area R2, the display control section 172 changes the image to be displayed in the first area R1 from the first image G1 to the third image G3, and at the same time, changes the image to be displayed in the second area R2 from the third image G3 to the fourth image G4.

A4. Operation Example of Detecting Position of Pointing Element 2

Figure 7:
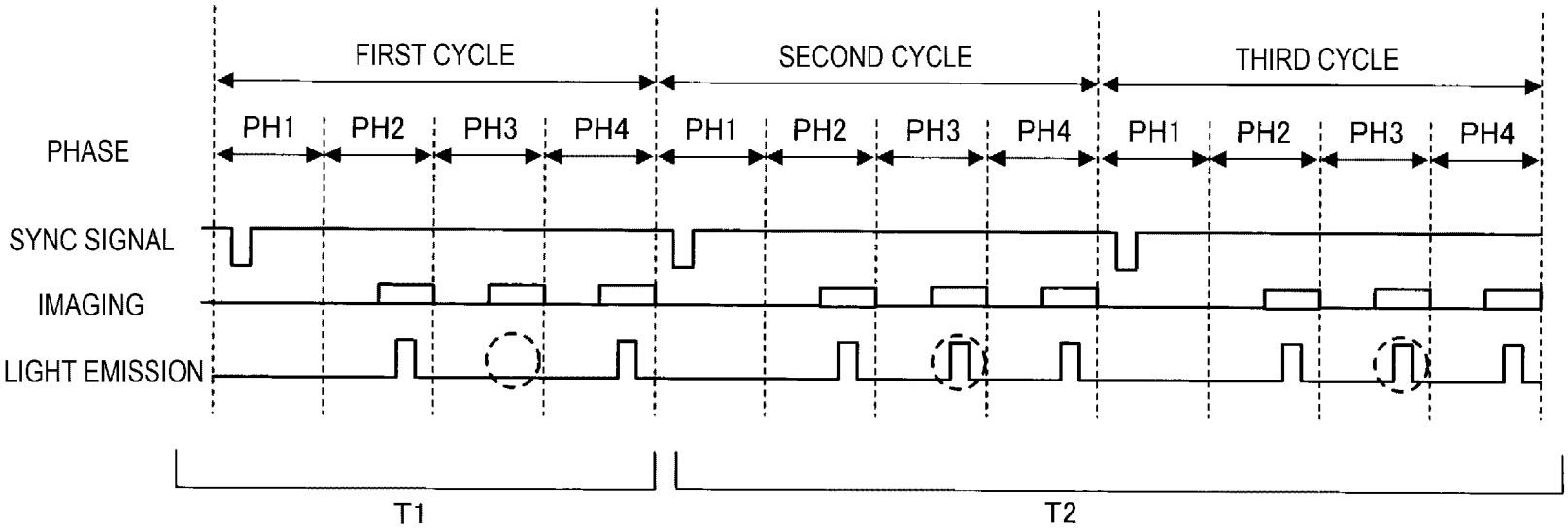
FIG. 7 is a diagram for explaining an operation sequence of the pointing element 2.

FIG. 7 is a diagram for explaining an operation sequence of the pointing element 2.

In the sequence shown in FIG. 7, each of a first cycle through a third cycle is provided with four phases, namely a first phase PH1 through a fourth phase PH4. The first phase PH1 through the fourth phase PH4 are repeated in sequence.

The first phase PH1 is a synchronization phase.

The pointing element control section 26 receives the sync signal from the projector 1 via the first communication section 22 to thereby recognize the start timing of the first phase PH1. The respective periods of the first phase PH1 through the fourth phase PH4 are set the same as each other. Therefore, the pointing element control section 26 recognizes the start timing of the first phase PH1 to thereby also recognize the start timing of each of the second phase PH2 through the fourth phase PH4.

The second phase PH2 and the fourth phase PH4 are the phases for the position detection.

The pointing element control section 26 makes the first light source 23 emit light in each of the second phase PH2 and the fourth phase PH4. The projector 1 performs imaging with the camera 15 in sync with the light emitting timing of the pointing element 2. In the imaging data generated by the camera 15 performing imaging, there is shown the light emission by the pointing element 2 as a bright point.

The third phase PH3 is a phase for contact determination.

The switch 24 turns to the ON state in accordance with the pressure to the tip 2*a*. When the switch 24 is in the ON state, the first light source 23 emits light in the third phase PH3. When the first light source 23 emits light in the third phase PH3, the light emission by the pointing element 2 is shown as the bright point in the imaging data of the camera 15 in the third phase PH3.

The projector 1 uses the imaging data generated in each of the second phase PH2 and the fourth phase PH4, and the calibration data to thereby identify the position coordinate representing the position of the pointing element 2 in each of the second phase PH2 and the fourth phase PH4. The projector determines the pointing coordinate approximate to the position coordinate identified by using the imaging data generated in the third phase PH3 and the calibration data out of the position coordinates respectively identified in the second phase PH2 and the fourth phase PH4 as the position where the pointing element 2 has had contact with the projection surface 4, namely the operation position.

A5. Operation Example of Writing

Figure 8:
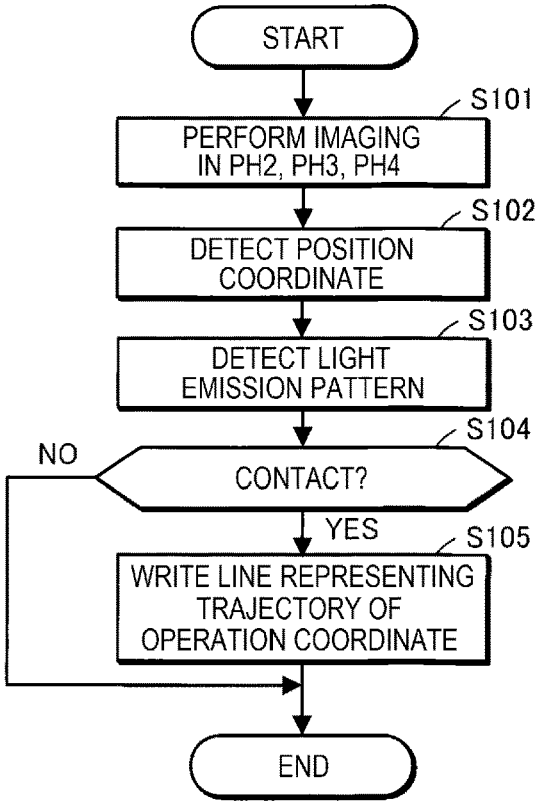
FIG. 8 is a flowchart for explaining an example of a writing operation.

FIG. 8 is a flowchart for explaining an example of the writing operation. The operation shown in FIG. 8 is repeatedly performed. In the description using FIG. 8, it is assumed that the pointing element 2 and the projector 1 operate in a state of being synchronized with each other along the sequence shown in FIG. 7. It is also assumed that the calibration has already been performed, and the calibration data has been stored in the storage section 16.

In the step S101, the camera 15 performs imaging of the infrared light to thereby generate the imaging data in each of the second phase PH2, the third phase PH3, and the fourth phase PH4.

In the step S102, the display control section 172 analyzes the imaging data to thereby detect the position of the pointing element 2 in the image represented by the imaging data. The display control section 172 uses the calibration data to convert the position of the pointing element 2 in the imaging data into the position coordinate representing the position on the frame memory 142.

In the step S103, the display control section 172 analyzes the imaging data to detect the light emission pattern of the pointing element 2.

In the step S104, the display control section 172 determines whether or not the pointing element 2 has had contact with the projection surface 4 based on the light emission pattern of the pointing element 2.

When the light emission pattern of the pointing element 2 is a light emission pattern representing the contact between the pointing element 2 and the projection surface 4, the display control section 172 detects in the step S105 the position coordinate approximate to the position coordinate identified in the third phase PH3 as the operation position out of the position coordinates respectively identified in the second phase PH2 and the fourth phase PH4. Then, the display control section 172 writes the writing image 5 as the line representing the trajectory of the operation position in the second image G2 as shown in, for example, FIG. 2.

When the light emission pattern of the pointing element 2 is a light emission pattern representing the fact that the pointing element 2 does not have contact with the projection surface 4, the display control section 172 terminates the operation shown in FIG. 8.

A6. Operation Example of Image Switching

Figure 9:
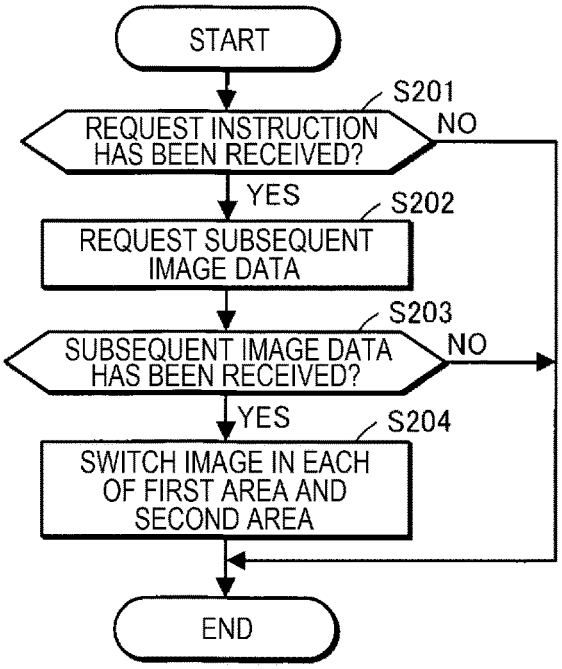
FIG. 9 is a flowchart for explaining an example of an image switching operation.

FIG. 9 is a flowchart for explaining an example of an image switching operation by the projector 1. The operation shown in FIG. 9 is repeatedly performed. In the description using FIG. 9, it is assumed that the projector 1 displays an image formed used the two pieces of image data, for example, the image G shown in FIG. 1, on the projection surface 4.

In the step S201, when the display control section 172 analyzes the imaging data to thereby detect an operation on the update button 6 by the pointing element 2, the display control section 172 determines that the request instruction for requesting the subsequent image data has been received from the user.

When the display control section 172 fails to detect an operation on the update button 6 by the pointing element 2 by analyzing the imaging data, the display control section 172 determines that the request instruction has not been received from the user. When the request instruction has not been received from the user, the operation shown in FIG. 9 terminates.

When the display control section 172 receives the request instruction from the user, the display control section 172 requests the subsequent image data to the PC 3 in the step S202. The PC 3 transmits the subsequent image data to the projector 1 in response to the request of the subsequent image data.

In the step S203, the determination section 173 determines whether or not the projector 1 receives the subsequent image data. Here, in the present embodiment, the event that the projector 1 receives the subsequent image data is used as the first condition, and moreover, as the change condition. Therefore, in the step S203, the determination section 173 substantively determines whether or not the change condition is fulfilled.

It should be noted that in the step S203, when the projector 1 receives the subsequent image data within a predetermined time from when the request instruction has been received from the user, the determination section 173 determines that the projector 1 receives the subsequent image data. The predetermined time is, for example, 5 seconds. The predetermined time is not limited to 5 seconds, and can be longer than 5 seconds, or can also be shorter than 5 seconds.

Further, in the step S203, when the projector 1 does not receive the subsequent image data within the predetermined time from when the request instruction has been received from the user, the determination section 173 determines that the projector 1 does not receive the subsequent image data.

When the determination section 173 determines that the projector 1 has received the subsequent image data, namely when the determination section 173 determines that the change condition is fulfilled, the display control section 172 switches the image in each of the first area R1 and the second area R2 in the step S204.

In the step S204, when the result of the determination by the determination section 173 is affirmative in the circumstance in which, for example, the first image G1 is displayed in the first area R1 and the third image G3 is displayed in the second area R2, the display control section 172 changes the image to be displayed in the first area R1 from the first image G1 to the third image G3, and at the same time, changes the image to be displayed in the second area R2 from the third image G3 to the fourth image G4.

For example, the display control section 172 firstly captures the third image G3 to thereby generate the third image data. Subsequently, the display control section 172 changes the image data to be stored in the first buffer 162*a* from the first image data to the third image data.

It should be noted that when the third image data is stored in the third buffer 162*c*, it is possible for the display control section 172 to change the image data to be stored in the first buffer 162*a* from the first image data to the third image data stored in the third buffer 162*c* without capturing the third image G3.

Subsequently, the display control section 172 changes the image data stored in the second buffer 162*b* from the second image data to the subsequent image data. Subsequently, the display control section 172 retrieves the third image data from the first buffer 162*a*, and then outputs the third image data to the image processing section 141. Subsequently, the display control section 172 retrieves the subsequent image data from the second buffer 162*b*, and then outputs the subsequent image data to the image processing section 141.

When the image processing section 141 receives the third image data and the subsequent image data, the image processing section 141 generates the image signal representing the image in which the third image G3 is located in the first area R1 and the fourth image G4 is located in the second area R2 as shown in FIG. 3 using the frame memory 142. By the image processing section 141 outputting the image signal to the light valve drive section 143, the projection section 14 projects the image in which the third image G3 is located in the first area R1 and the fourth image G4 is located in the second area R2 on the projection surface 4.

Further, in the step S204, when the result of the determination by the determination section 173 is affirmative in the circumstance in which, for example, the first image G1 is displayed in the first area R1 and the second image G2 is displayed in the second area R2, the display control section 172 changes the image to be displayed in the first area R1 from the first image G1 to the second image G2, and at the same time, changes the image to be displayed in the second area R2 from the second image G2 to the fourth image G4.

For example, the display control section 172 firstly captures the second image G2 to thereby generate the second image data. Subsequently, the display control section 172 changes the image data to be stored in the first buffer 162*a* from the first image data to the second image data.

It should be noted that it is possible for the display control section 172 to change the image data stored in the first buffer 162*a* from the first image data to the second image data stored in the second buffer 162*b* without capturing the second image G2.

Subsequently, the display control section 172 changes the image data stored in the second buffer from the second image data to the subsequent image data. Subsequently, the display control section 172 retrieves the second image data from the first buffer 162*a*, and then outputs the second image data to the image processing section 141. Subsequently, the display control section 172 retrieves the subsequent image data from the second buffer 162*b*, and then outputs the subsequent image data to the image processing section 141.

When the image processing section 141 receives the second image data and the subsequent image data, the image processing section 141 generates the image signal representing the image in which the second image G2 is located in the first area R1 and the fourth image G4 is located in the second area R2 as shown in FIG. 4 using the frame memory 142. By the image processing section 141 outputting the image signal to the light valve drive section 143, the projection section 14 projects the image in which the second image G2 is located in the first area R1 and the fourth image G4 is located in the second area R2 on the projection surface 4.

When the determination section 173 determines in the step S203 that the projector 1 does not receive the subsequent image data, namely the determination section 173 determines that the change condition is not fulfilled, the operation shown in FIG. 9 terminates.

A7. Conclusion of First Embodiment

The method of operation of the display device and the display device according to the present embodiment described above include the following aspects.

The projection section 14 displays the first image G1 in the first area R1, and at the same time, displays the second image G2 in the second area R2. The display control section 172 controls the projection section 14 to display the third image G3 in the second area R2 instead of the second image G2, wherein the third image G3 is formed by superimposing the writing image 5 based on the writing operation to the second image G2 on the second image G2. The determination section 173 determines whether or not the change condition is fulfilled. When the change condition is fulfilled in the circumstance in which the first image G1 is displayed in the first area R1 and the third image G3 is displayed in the second area R2, the display control section 172 makes the projection section 14 execute the operation of changing the image to be displayed in the first area R1 from the first image G1 to the third image G3, and at the same time, changing the image to be displayed in the second area R2 from the third image G3 to the fourth image G4.

According to this aspect, even when the image to be displayed in the second area R2 is changed from the third image G3 to the fourth image G4, the third image G3 is displayed in the first area R1. Since the third image G3 is an image formed by superimposing the writing image 5 on the second image G2, it becomes possible to display the content of the writing executed in the first area R1 in the second area.

Therefore, for example, it is possible for the student to continue to confirm the important information written by the teacher.

The fourth image G4 is an image represented by the subsequent image data supplied to the projector 1 from the PC 3 temporally posterior to the second image data representing the second image G2. Therefore, the images represented by the image data supplied from the PC 3 out of the images displayed in the second area R2 can be updated in the order in which the image data are supplied from the PC 3.

When the projector 1 receives the request instruction of requesting the subsequent image data from the user, the projector 1 requests the subsequent image data to the PC 3 as the supply source of the subsequent image data, and then receives the subsequent image data supplied by the PC3 in response to the request. Therefore, it becomes possible for the user to make the projector 1 obtain the subsequent image data by making the request instruction as needed.

The change condition is the first condition that the projector 1 receives the subsequent image data. Therefore, when the display control section 172 receives the subsequent image data in the circumstance in which the third image G3 is displayed in the second area R2, it is possible for the display control section 172 to make the projection section 14 execute the operation of changing the image to be displayed in the first area R1 from the first image G1 to the third image G3, and at the same time, changing the image to be displayed in the second area R2 from the third image G3 to the fourth image G4.

B. Modified Examples

Some aspects of the modifications of the embodiment illustrated hereinabove will be illustrated blow. It is also possible to arbitrarily combine tow or more aspects arbitrarily selected from the following illustrations with each other within a range in which the aspects do not conflict with each other.

B1. First Modified Example

In the first embodiment, when whether or not the second image data and the subsequent image data are different from each other is unclear, it is also possible to use a second condition that the second image data and the subsequent image data are different from each other as the change condition. In this case, the determination section 173 compares the second image data stored in the second buffer 162*b* and the subsequent image data with each other to thereby determine whether or not the second image data and the subsequent image data are different from each other. When the change condition is the second condition, the display control section 172 executes the step S204 shown in FIG. 9 when the determination section 173 determines that the subsequent image data representing the image different from the second image G2 has been received.

According to the first modified example, it is possible to change the image to be displayed in the first area R1 and the image to be displayed in the second area R2 in accordance with the update of the image data supplied from the PC 3. Further, it becomes possible for the projector 1 to determine presence or absence of the update in the image data supplied from the PC 3.

B2. Second Modified Example

In the first embodiment, when the PC 3 transmits a supply signal representing the supply of the subsequent image data when supplying the subsequent image data, the change condition can also be a third condition that the projector 1 receives the supply signal. In this case, the determination section 173 determines whether or not the projector 1 has received the supply signal. When the change condition is the third condition, the display control section 172 executes the step S204 shown in FIG. 9 when the determination section 173 determines that the projector 1 has received the supply signal.

According to the second modified example, it is possible to make the determination by the determination section 173 easier than, for example, the determination on whether or not the second image data and the subsequent image data are different from each other.

It should be noted that the transmission source of the supply signal is not limited to the PC 3, but can also be, for example, a control device not shown for controlling the PC 3.

B3. Third Modified Example

In the first embodiment, the change condition can also be a sixth condition that a fourth condition is fulfilled and at the same time a fifth condition is fulfilled. The fourth condition is, for example, either one of the first condition described above, the second condition described above, and the third condition described above. The fifth condition is a condition that, for example, the projector 1 has not received a keep instruction of keeping the image to be displayed in the first area R1 from the user.

Figure 10:
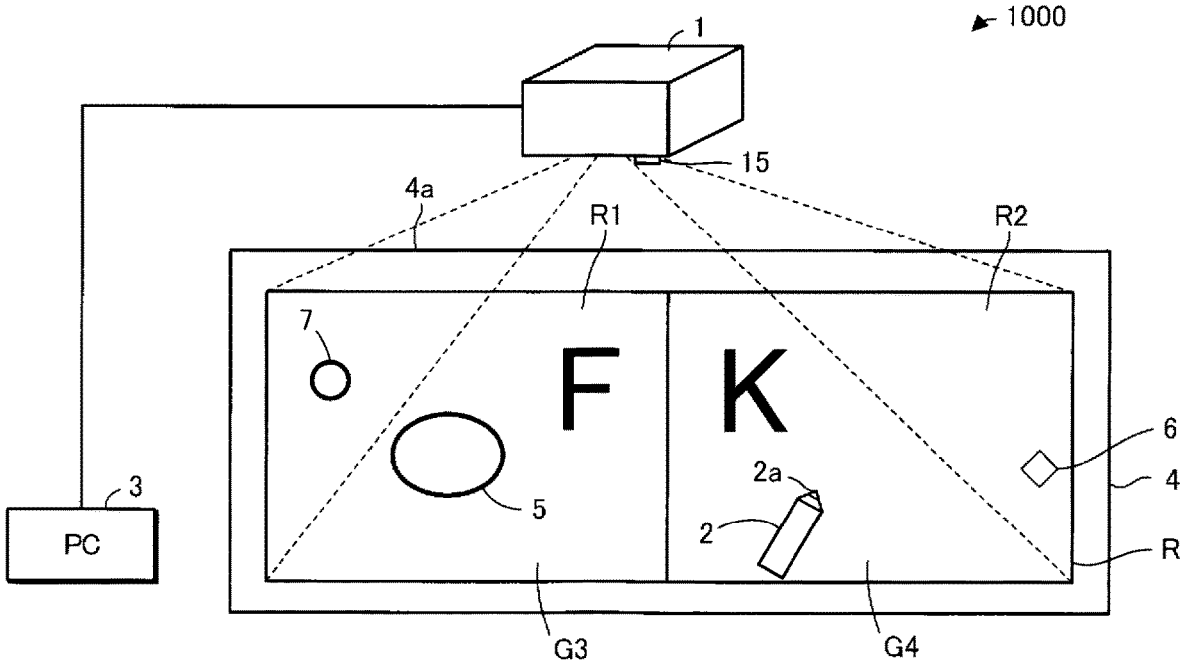
FIG. 10 is a diagram for explaining a third modified example.

As an example of the keep instruction, for example, as shown in FIG. 10, there can be cited a state in which an object 7 for keeping the image to be displayed in the first area R1 by inhibiting the change of the image to be displayed in the first area R1 is located in the first area R1. The object 7 has, for example, a magnet, and is located on the projection surface 4 such as a whiteboard due to the magnetic force of the magnet. It should be noted that the object 7 can be attached on the projection surface 4 with a material having an adherence property.

The object 7 has a light source for emitting, for example, infrared light. The light source of the object 7 is larger than the first light source 23 of the pointing element 2. Therefore, the determination section 173 distinguishes the object 7 and the pointing element 2 from each other based on the difference in size of the bright point represented by the imaging data.

When the bright point corresponding to the object 7 is located in the first area R1, the determination section 173 determines that the projector 1 has received the keep instruction from the user. In this case, the fifth condition that the projector 1 has not received the keep instruction from the user is not fulfilled.

When the bright point corresponding to the object 7 is not located in the first area R1, the determination section 173 determines that the projector 1 has not received the keep instruction from the user. In this case, the fifth condition is fulfilled.

The shape of the object 7 is not limited to the shape shown in FIG. 10, but can arbitrarily be changed. The shape of the object 7 can be, for example, a circular cylinder, a quadratic prism, a triangular prism, or a hemisphere.

Further, it is possible for a picture or a character of a fixing tool such as a pin for fixing the position of a paper medium to be described on the surface of the object 7. In this case, it is possible for the user to intuitively recognize the function of the object 7, namely the function of inhibiting the image displayed in the first area R1 from changing to thereby keep the image displayed in the first area R1. Therefore, it is possible for the user to intuitively perform the operation of the object 7.

Figure 11:
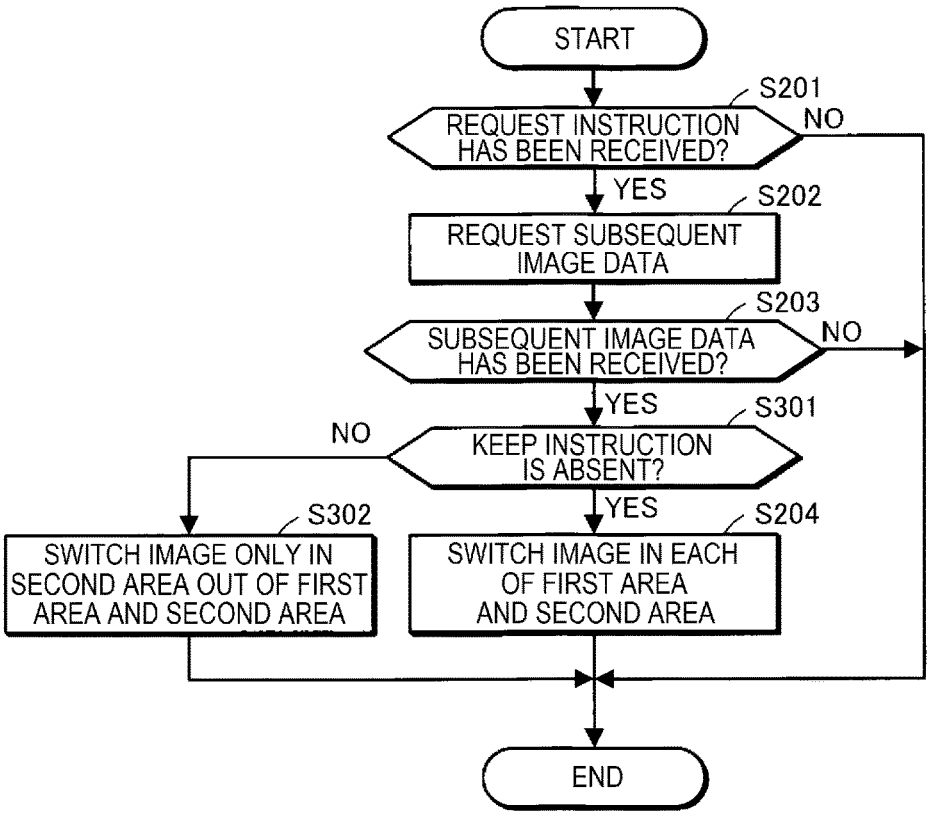
FIG. 11 is a flowchart for explaining an example of the image switching operation when a change condition is a sixth condition.

FIG. 11 is a flowchart for explaining an example of the image switching operation when a change condition is the sixth condition. In FIG. 11, the same processes as those shown in FIG. 9 are denoted by the same reference symbols. Hereinafter, the description will be presented with a focus on the processes different from the processes shown in FIG. 9 out of the processes shown in FIG. 11.

When the subsequent image data is received in the step S203, the determination section 173 determines in the step S301 whether or not the bright point corresponding to the object 7 is located in the first area R1 using the imaging data and the calibration data. When the bright point corresponding to the object 7 is not located in the first area R1, the determination section 173 determines that the keep instruction has not been received. When the bright point corresponding to the object 7 is located in the first area R1, the determination section 173 determines that the keep instruction has been received.

When it is determined in the step S301 that the keep instruction has not been received, the step S204 is executed.

When it is determined in the step S301 that the keep instruction has been received, the display control section 172 switches the image only in the second area R2 out of the first area R1 and the second area R2 in the step S302.

In the step S302, in the circumstance in which, for example, the first image G1 is displayed in the first area R1 and the third image G3 is displayed in the second area R2, the display control section 172 keeps the image to be displayed in the first area R1 as the first image G1, and at the same time, changes the image to be displayed in the second area R2 from the third image G3 to the fourth image G4.

Further, in the step S302, in the circumstance in which, for example, the first image G1 is displayed in the first area R1 and the second image G2 is displayed in the second area R2, the display control section 172 keeps the image to be displayed in the first area R1 as the first image G1, and at the same time, changes the image to be displayed in the second area R2 from the second image G2 to the fourth image G4.

As described above, in the step S302, when the display control section 172 receives the subsequent image data in the circumstance in which the keep instruction has been received, the display control section 172 changes the image displayed in the second area R2 to the fourth image G4 without changing the image displayed in the first area R1.

Therefore, in the third modified example, it is possible for the user to intentionally inhibit the change of the image displayed in the first area R1.

Therefore, it becomes possible to continue to display the important information in the class such as a formula in the first area R1 while changing the image to be displayed in the second area R2. Therefore, it becomes possible to effectively proceed with the class.

Further, by removing the object 7 from the first area R1, it is possible for the user to update the image to be displayed in the first area R1 in sync with the update timing of the image to be displayed in the second area R2.

B4. Fourth Modified Example

In the first embodiment and the first through third modified examples, it is possible for the third image data to have the second image data and the writing image data representing the writing image 5 separately from each other in, for example, a layered structure.

In this case, it becomes possible to easily delete the writing image 5 from the third image G3 displayed in the first area R1.

B5. Fifth Modified Example

In the first embodiment and the first through fourth modified examples, it is also possible for the projector 1 to output the third image data to an external device via, for example, a USB cable.

B6. Sixth Modified Example

In the first embodiment and the first through fifth modified examples, the fourth image G4 is not limited to the image represented by the subsequent image data, but can also be an image represented by the second image data, or image data supplied temporally anterior to the second image data such as the first image data.

In this case, for example, it becomes possible to display an image on which the writing has not been performed, such as the second image G2, and an image on which the writing has been performed, such as the third image G3 side by side.

B7. Seventh Modified Example

In the first embodiment and the first through sixth modified examples, the pointing element 2 can also be an object not emitting the infrared light such as a finger of a human. In this case, a light output device which emits the infrared light like a plane along the projection surface 4 is disposed above the upper end 4*a* of the projection surface 4.

The projector 1 images the reflected light reflected by the pointing element 2 on the projection surface 4 out of the infrared light emitted from the light output device using the camera 15.

The projector 1 analyzes the imaging data generated by imaging with the camera 15 to thereby identify the operation position by the pointing element 2.

B8. Eighth Modified Example

In the first embodiment and the first through seventh modified example, it is also possible to provide the operation section 11 with a physical update button for inputting the request instruction. Further, it is also possible to provide the operation section 11 with a physical keep instruction button for inputting the keep instruction.

B9. Ninth Modified Example

In the first embodiment and the first through eighth modified examples, it is also possible for the projector 1 to have a writing mode of executing writing with the pointing element 2 and a mouse mode of using the pointing element 2 as a so-called a mouse as the operation modes.

The operation control section 171 switches the operation mode in accordance with, for example, a mode switching input to the operation section 11.

In this case, the writing image 5 is formed in the writing mode, and operation to the update button 6 is performed in the mouse mode.

B10. Tenth Modified Example

Although the liquid crystal light valves 145 are used as an example of the light modulation device in the first embodiment and the first through ninth modified examples, the light modulation device is not limited to the liquid crystal light valves, and can arbitrarily be changed. For example, it is also possible for the light modulation device to have a configuration using three reflective liquid crystal panels. Further, it is also possible for the light modulation device to have a configuration such as a system using a single liquid crystal panel, a system using three digital mirror devices (DMD), or a system using a single digital mirror device. When using just one liquid crystal panel or DMD as the light modulation device, the members corresponding to the color separation optical system and the color combining optical system are unnecessary. Further, besides the liquid crystal panel and the DMD, any configurations capable of modulating the light emitted by the second light source 144 can be adopted as the light modulation device.

B11. Eleventh Modified Example

In the first embodiment and the first through tenth modified examples, when an FPD is used instead of the projector 1 as the display device, the FPD as the display device can also be an FPD used in, for example, an electronic blackboard or an electronic conferencing system.

What is claimed is:

1. A method of operation performed by a display device configured to display an image on a display surface, the method comprising:

displaying a first image in a first area of the display surface, and displaying a second image in a second area different from the first area of the display surface;

displaying a third image formed by superimposing a writing image based on a writing operation to the second image on the second image in the second area instead of the second image;

determining whether or not a condition for changing an image to be displayed in the first area and an image to be displayed in the second area is fulfilled; and changing the image to be displayed in the first area from the first image to the third image and changing the image to be displayed in the second area from the third image to a fourth image when it is determined in the determination that the condition is fulfilled in a circumstance in which the first image is displayed in the first area and the third image is displayed in the second area, wherein the first and second areas are on the same display surface, the first, second, third and fourth images are displayed by the same display device, the condition is a first condition that a second condition is fulfilled and a third condition is fulfilled, the second condition is one of a condition that the display device receives subsequent image data to be supplied to the display device temporally posterior to image data representing the second image, a condition that the display device receives a supply signal representing supply of the subsequent image data, and a condition that the image data representing the second image and the subsequent image data are different from each other, and the third condition is a condition that the display device failed to receive a keep instruction of keeping the image to be displayed in the first area from a user.

2. The method of operation according to claim 1, wherein the fourth image is an image represented by the subsequent image data.

3. The method of operation according to claim 2, further comprising:

requesting the subsequent image data to a supply source of the subsequent image data when a request instruction of requesting the subsequent image data is received from the user; and receiving the subsequent image data which the supply source supplies in response to the request.

4. The method of operation according to claim 1, wherein the fourth image is an image represented by the subsequent image data different from the image data representing the second image.

5. The method of operation according to claim 1, further comprising:

changing the image to be displayed in the second area to the fourth image without changing the image to be displayed in the first area when the display device receives the subsequent image data in a circumstance in which the display device receives the keep instruction from the user.

6. A display device configured to display an image on a display surface, the display device comprising:

a projection optical system configured to display a first image in a first area of the display surface, and display a second image in a second area different from the first area of the display surface; and one or more processors programmed to control the projection optical system, and determine whether or not a condition for changing an image to be displayed in the first area and an image to be displayed in the second area is fulfilled, wherein the one or more processors make the projection optical system perform an operation of displaying a third image formed by superimposing a writing image based on a writing operation to the second image on the second image in the second area instead of the second image, and an operation of changing the image to be displayed in the first area from the first image to the third image and changing the image to be displayed in the second area from the third image to a fourth image when it is determined that the condition is fulfilled in a circumstance in which the first image is displayed in the first area and the third image is displayed in the second area, wherein the first and second areas are on the same display surface, the first, second, third and fourth images are displayed by the same display device, the condition is a first condition that a second condition is fulfilled and a third condition is fulfilled, the second condition is one of a condition that the display device receives subsequent image data to be supplied to the display device temporally posterior to image data representing the second image, a condition that the display device receives a supply signal representing supply of the subsequent image data, and a condition that the image data representing the second image and the subsequent image data are different from each other, and the third condition is a condition that the display device failed to receive a keep instruction of keeping the image to be displayed in the first area from a user.

* * * * *